US005189800A

United States Patent [19]

Morita et al.

[11] Patent Number: 5,189,800

[45] Date of Patent: Mar. 2, 1993

[54] DEVICE FOR DRAWING ELLIPTICAL CURVES

[76] Inventors: Shiro Morita, 17-10, Sennari 2-chome, Sakura-shi, Chiba 285; Kazuo Yoshitake, 32-21, Minamihanahata 3-chome, Adachi-ku, Tokyo 121, both of Japan

[21] Appl. No.: 837,700

[22] Filed: Feb. 19, 1992

Related U.S. Application Data

[63] Continuation of Ser. No. 520,617, May 8, 1990, abandoned.

[30] Foreign Application Priority Data

May 8, 1989 [JP] Japan ..... 1-114768

[51] Int. Cl.[5] ..... B43L 11/04; B43L 11/055

[52] U.S. Cl. ..... 33/30.1; 33/31

[58] Field of Search ..... 33/30.1, 30.2, 30.4, 33/30.6, 30.7, 31, 27.01, 27.03

[56] References Cited

U.S. PATENT DOCUMENTS

| | | | |
|---|---|---|---|
| 422,252 | 2/1890 | Rawson | 33/31 |
| 517,522 | 4/1894 | King | 33/31 |
| 2,494,557 | 1/1950 | Irick | 33/31 |
| 2,777,199 | 1/1957 | Neiglick | 33/31 |
| 2,879,596 | 3/1959 | Kroenlein | 33/31 |
| 2,996,804 | 8/1961 | Hancox | 33/31 |
| 4,166,320 | 9/1979 | Magnat | 33/31 |
| 4,174,572 | 11/1979 | Mikulin | 33/31 |
| 4,306,598 | 12/1981 | Peot | 33/31 |
| 4,878,409 | 11/1989 | Carithers, Jr. | 33/27.01 |

*Primary Examiner*—William A. Cuchlinski, Jr.
*Assistant Examiner*—C. W. Fulton
*Attorney, Agent, or Firm*—Staas & Halsey

[57] ABSTRACT

An elliptical curve drawing device draws an ellipse having desired minor and major axes along given central axes. The device includes a y-axis movable member movably mounted on a base plate for movement along a y-axis which extends perpendicularly to a straight side of the base plate, and an x-axis movable member movably mounted on the base plate for movement along an x-axis which extends parallel to the straight side. The x- and y-axes are brought into alignment respectively with the major and minor axes of an ellipse to be drawn. The elliptical curve follows the path of movement of a point which is spaced from the circumference of a circle which is concentric with the ellipse and whose radius is A, equal to half of the minor axis of the ellipse, by a distance, parallel to the x-axis, which is equal to B $\cos\theta$ where B is the half of the difference between the major axis $2(A+B)$ and the minor axis 2A of the ellipse and $\theta$ is the angle formed between the length B and the x-axis. In drawing the ellipse, the central axes of the ellipse can easily be aligned with desires minor and major axes through a simple positioning process. The elliptical curve drawing device can easily be handled in use, and a sufficient drawing pressure is developed on the tip of the drawing instrument for drawing the ellipse.

4 Claims, 3 Drawing Sheets

DEVICE FOR DRAWING ELLIPTICAL CURVES

This application is a continuation, of application number 07/520,617, filed May 8, 1990, now abandoned.

BACKGROUND OF THE INVENTION

1. Field of the Invention

The present invention relates to a device for drawing an elliptical curve having desired minor and major axes along given central axes.

2. Description of the Prior Art

Ellipse templates are widely used to draw ellipses in the technical drawing practice. Such an ellipse template has a plurality of elliptical holes defined in a plastic plate. There are known various devices for drawing elliptical patterns having minor and major axes which cannot be drawn using existing ellipse templates.

An ellipse template allows the central axes of an ellipse to be easily aligned with two orthogonal axes which are preset in a drawing, but is unable to draw an ellipse having desired minor and major axes along given central axes. The conventional ellipse drawing devices are complex in structure, and cannot easily bring themselves into alignment with the central axes of an ellipse. Though the existing ellipse drawing devices are large in size, the elliptical curves which can be drawn by these ellipse drawing devices are limited to certain sizes.

The major problems with the earlier ellipse drawing devices are that a number of manual steps are required to position the central axes of an ellipse into alignment with desired minor and major axes, and hence the ellipse drawing devices cannot easily be handled, and also that the drawing pressure with which an elliptical pattern is drawn on a sheet is not sufficient. In order to obtain a necessary drawing pressure, a special attachment has to be added to the ellipse drawing device, which is rendered more complicated.

SUMMARY OF THE INVENTION

In view of the above problems of the conventional ellipse drawing devices, it is an object of the present invention to provide a device for drawing a wide variety of elliptical curves having desired minor and major axes and ranging from smaller to larger sizes, through a simple positioning process and under a sufficient drawing pressure.

According to the present invention, an elliptical curve drawing device draws an elliptical curve, whose major and minor axes are aligned with x- and y-axes, respectively, as the path of movement of a point which is spaced from the circumference of a circle which is concentric with the ellipse and whose radius is A, equal to half of the minor axis of the ellipse, by a distance, parallel to the x-axis, which is equal to B cos $\theta$ where B is half of the difference between the major axis 2(A+B) and the minor axis 2A of the ellipse and $\theta$ is the angle formed between the length B and the x-axis. The elliptical curve drawing device includes a base plate including a straight side for alignment with the x-axis, a y-axis movable member movably mounted on the base plate for movement along the y-axis which extends perpendicularly to the straight side, a pivot fixing member angularly movable supported on the y-axis movable member at a predetermined pivot position, an x-axis movable member movably mounted on the base plate for movement along the x-axis which extends parallel to the straight side, a first arm having one end angularly movably supported on the x-axis movable member by a core shaft on the x-axis movable member, the first arm being connected to the y-axis movable member through the pivot fixing member, the arrangement being such that when the x-axis movable member is moved, the first arm keeps a predetermined distance B between the core shaft which determines a point of intersection between the x- and y-axes and the pivot position of the y-axis movable member, a second arm angularly movably supported on the x-axis movable member by the core shaft and extending away from the first arm in line therewith, and a drawing instrument attachment adjustably fixed to the second arm and spaced from the core shaft by a distance A. The elliptical curve drawing device according to the present invention allows the user to draw elliptical curves simply and accurately.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
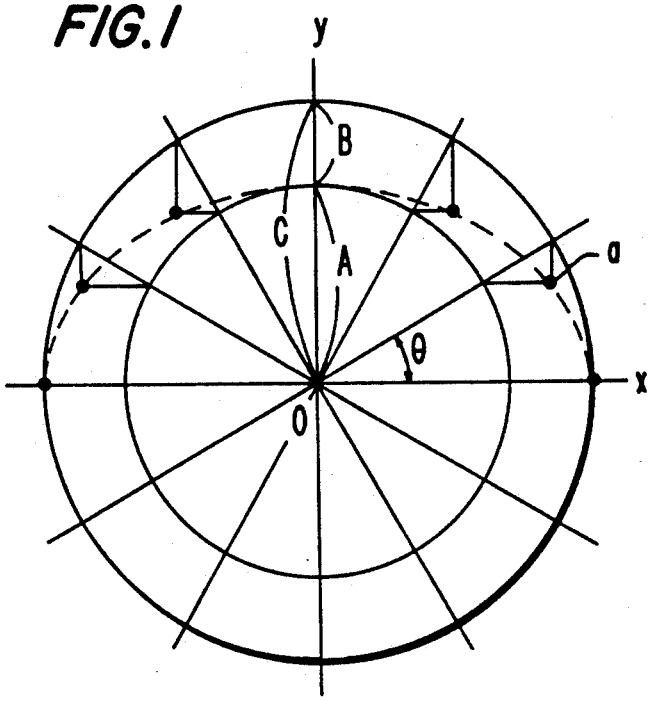
FIG. 1 is a diagram showing an elliptical curve drawn by an elliptical curve drawing device according to the present invention.

FIG. 1 shows two curves and an ellipse drawn on a plane having x- and y-axes, the two circles having their center at the point (origin O) of intersection of the x- and y-axes. The ellipse which is drawn from these two circles have a major axis having a length of 2C and a minor axis having a length of 2A. The ellipse, which is drawn on the basis of the circle having its center at O and a radius C (=A+B) and the circle having its center at O and a radius A, is indicated by the dot-and-dash line with the major and minor axes aligned with the x- and y-axes. The elliptical curve follows the path of movement of a point a which is spaced from the circumference of the circle whose diameter is 2A, equal to the minor axis of the ellipse, by a distance, parallel to the x-axis, which is equal to B cos $\theta$ where B is the half of the difference between the major axis 2(A+B) and the minor axis 2A of the ellipse and $\theta$ is the angle formed between the length B and the x-axis.

Figure 2:
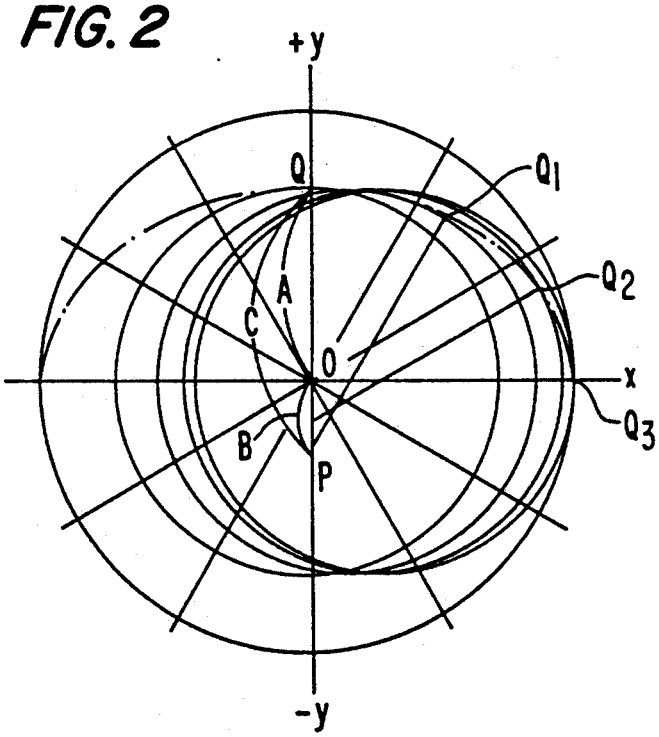
FIG. 2 is a diagram illustrative of the principles of the elliptical curve drawing device according to the present invention.

FIG. 2 schematically illustrates the principles based on which an elliptical curve drawing device according to the present invention operates in drawing such an ellipse. A point Q is set up at a position+A which is spaced from the origin O along the y-axis, and a point P is set up at a position-B which is spaced from the origin O along the y-axis. A line segment whose length is C between the points P, Q is angularly moved while a point on the line segment corresponding o the origin O is being fixed to the+ x-axis and the end point P is being fixed to the y-axis. Through such angular movement of the line segment, the point Q is moved successively through points Q1, Q2, Q3, drawing a quarter of an elliptical curve when the line segment is aligned with the+x-axis.

The elliptical curve drawing device which operates based on the above principles will be described below with reference to FIGS. 3 through 10.

Figure 3A:
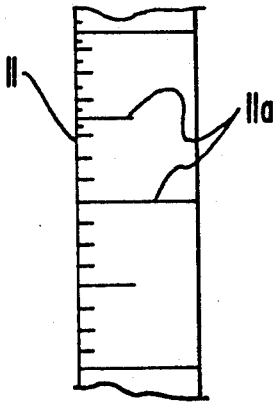
FIG. 3*a* is an enlarged plan view showing graduations on the base plate of the device of FIG. 3.
Figure 3:
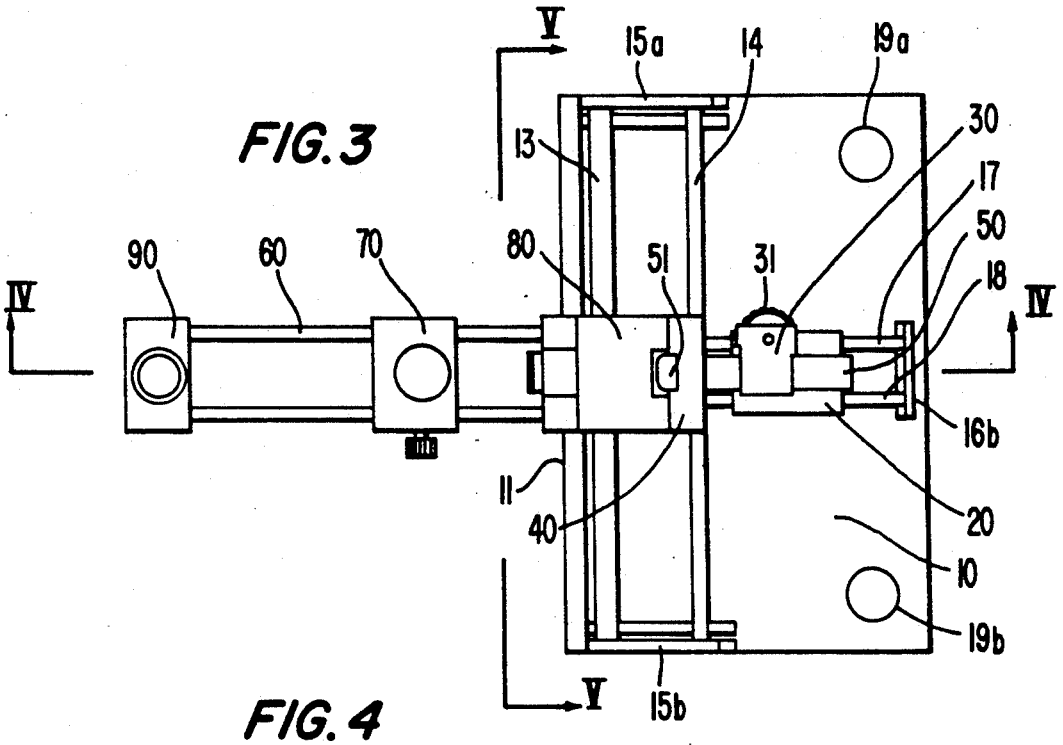
FIG. 3 is a plan view of the elliptical curve drawing device according to the present invention.
Figure 4:
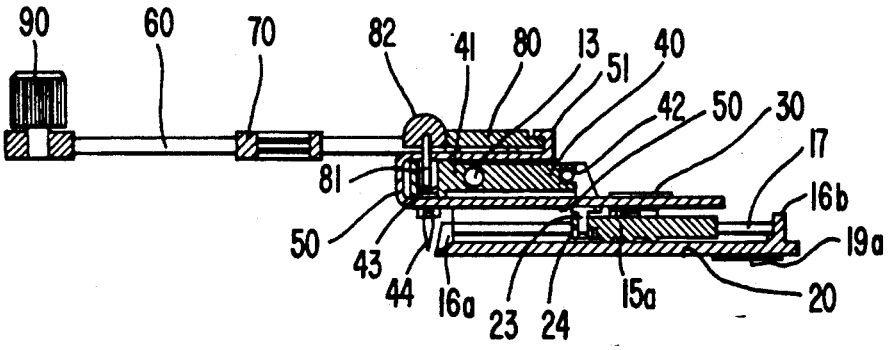
FIG. 4 is a vertical cross-sectional view taken along line IV—IV of FIG. 3.
Figure 5:
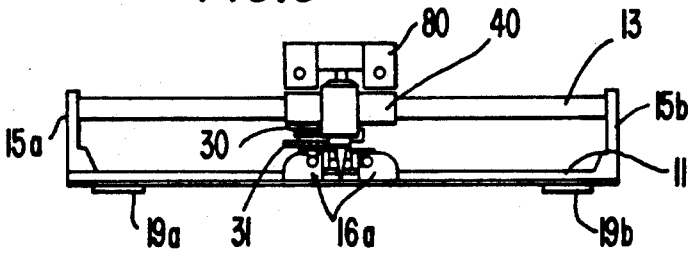
FIG. 5 is a front elevational view taken along line V—V of FIG. 3.
Figure 6:
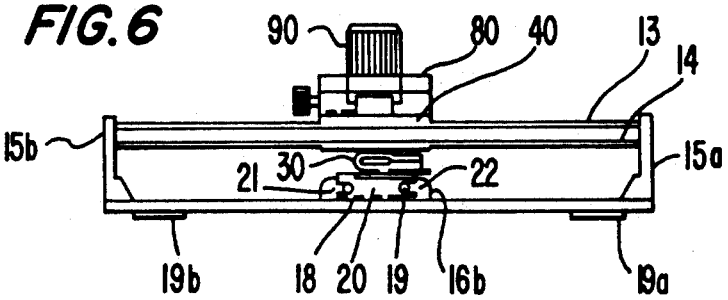
FIG. 6 is a rear elevational view of the elliptical curve drawing device.

As shown in FIGS. 3 and 4, a base plate 10 comprises a rectangular transparent plate of plastic which has a longer straight side 11 to be positioned in alignment with the x-axis. Two parallel x-axis rails 13, 14 are mounted on the base plate 10 along the longer side 11. Each of the rails 13, 14 is in the form of a metallic rod having a circular cross section. The rails 13, 14 are supported at their opposite ends by a pair of upstanding members 15*a*, 15*b* on opposite lateral sides of the base plate 10 and extend horizontally at a height slightly above the upper surface of the base plate 10. Two other y-axis rails 17, 18 are also mounted on the base plate 10 below the rails 13, 14 and cross the central portions of the rails 13, 14. The rails 17, 18 are supported at their opposite ends by a pair of upstanding members 16*a*, 16*b* on the longer side 11 and an opposite longer side of the base plate 10. The longer side 11 is marked with graduations which are used to align a core shaft (described later on) for determining the point of intersection of the x- and y-axes with the center O of an ellipse to be drawn, and to preset a value B for determining the eccentricity of such an ellipse. Friction pads 19*a*, 19*b* are fixed to the reverse side of the base plate 10, for holding the base plate 10 in position against displacement when the base plate 10 is placed on a sheet of drafting paper.

A y-axis movable member 20 is movably mounted on the base plate 10 for movement along the rails 17, 18. As shown in FIGS. 3 through 6, the y-axis movable member 20 is disposed between the rails 17, 18 and has grooves 21, 22 defined in opposite sides thereof, in which the rails 17, 18 are fitted, respectively. A pivot fixing member 30 is angularly movably supported by a pin 23 and a nut 24 on the upper surface of the movable member 20 near an end thereof closer to the core shaft. The pivot fixing member 30 is angularly movable about the pin 23 which corresponds to the end point P of the line segment PQ (FIG. 2), and is movable along the rails 21, 22 together with the y-axis movable member 20 which is fixed with respect to the y-axis.

An x-axis movable member 40, which is movable along the x-axis rails 13, 14, has a through hole 41 defined therein, through which the rail 13 extends, and a groove 42 defined in one side thereof, in which the rail 14 is fitted. The x-axis movable member 40 has a hole 43 defined in a portion thereof near the through hole 41 which projects from the longer side 11 of the base plate 10. A core shaft 81 of an arm mount 80 is inserted in the hole 43. A pin 44 for alignment with the origin projects downwardly and is fixed to the lower surface of the x-axis movable member 40 below the core shaft 81. A first arm 50 is angularly movable mounted on the x-axis movable member 40, the first arm 50 being bent from the lower surface toward the upper surface of the movable member 40 around the projecting portion thereof and hence the hole 43 defined therein. The first arm 50 has a portion supported substantially horizontally away from the core shaft 81 and having an end near the opposite longer side of the base plate 10. The first arm 50 is vertically sandwiched in position by the pivot fixing member 30, thus interconnecting the x-axis movable member 40 and the y-axis movable member 20. The other end of the first arm 50 which is bent upwardly over the x-axis movable member 40 is shaped as a hook 51. A second arm 60 extends in line with the first arm 50 and is detachably mounted on the upper surface of the x-axis movable member 40 by the hook 51 and the core shaft 81 of the arm mount 80, the arm mount 80 being detachable with the second arm 60.

When the x-axis movable member 40 moves along the rails 13, 14, the first arm 50 turns about the core shaft 81, causing the pivot fixing member 30 to move the y-axis movable member 20 to move back and forth along the rails 17, 18, so that the core shaft 81 and the pivot (pin 23) remain spaced from each other by a constant distance B. The distance B can be adjusted to a desired dimension when an adjustment screw 31 of the pivot fixing member 30 which vertically sandwiches the first arm 50 is loosened.

Figure 7:
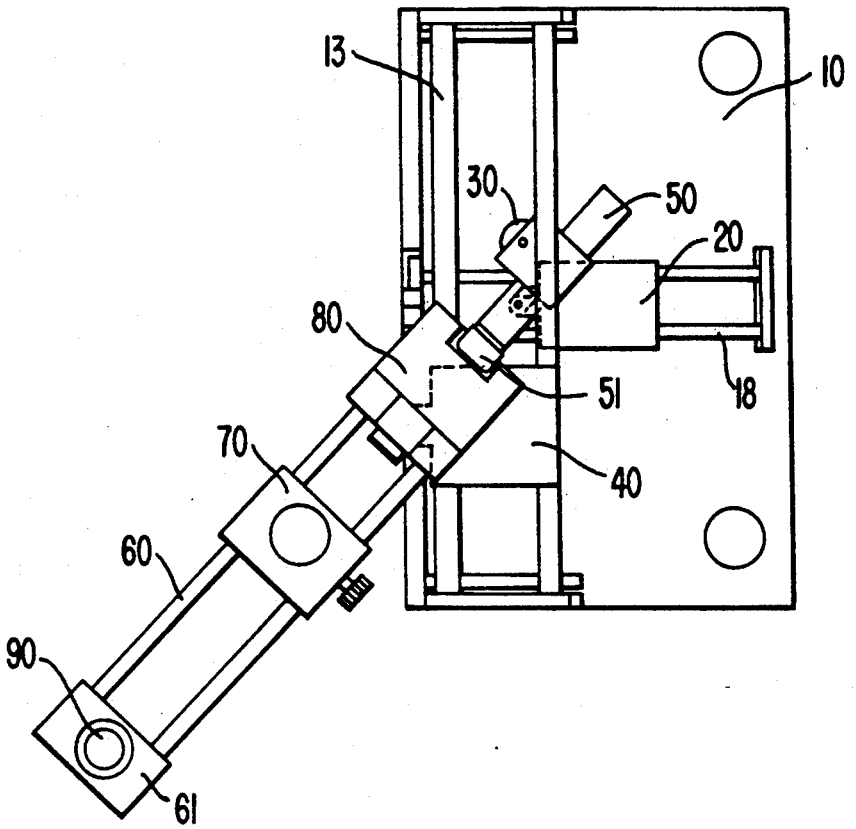
FIG. 7 is a plan view of the elliptical curve drawing device with arms turned 45°.

FIG. 7 shows the elliptical curve drawing device with the arms 50, 60 turned 45°.

As shown in FIG. 7, the second arm 60 comprises two parallel metal rods of circular cross section which are joined endwise to an end surface of the arm mount 80. A cylindrical knob 90 is rotatably mounted on an upper surface of a block 61 on the distal end of the second arm 60. A drawing instrument attachment 70 is slidably mounted on an intermediate portion of the second arm 60, the drawing instrument attachment 70 being fixable in a position which is spaced a distance A from the core shaft 81. The drawing instrument attachment 70 has a through hole 71 (FIG. 8) defined vertically therein for inserting therein a drawing instrument such as a pencil, a Rotring pen, or the like. The drawing instrument attachment 70 also has a threaded hole defined in a side surface thereof in which a screw 72 (see also FIG. 10) is threaded and held against a side of one of the metal rods of the second arm 60 to secure the attachment 70 in position on the second arm 60. If a drawing instrument which has a diameter that does not fit the inside diameter of the hole 71 is to be mounted on the attachment 70, an adapter which fits the outside diameter of the drawing instrument through adjustment of an inside diameter of the adapter is mounted in the hole 71 in the second arm 60.

Figure 8:
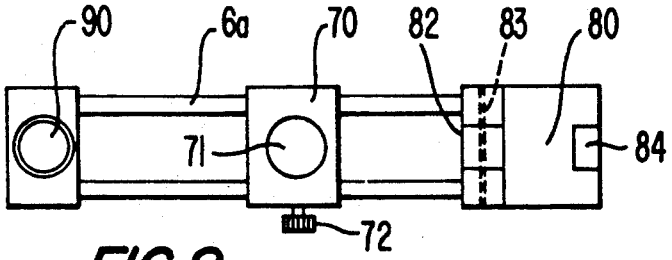
FIG. 8 is a plan view of a first arm.
Figure 9:
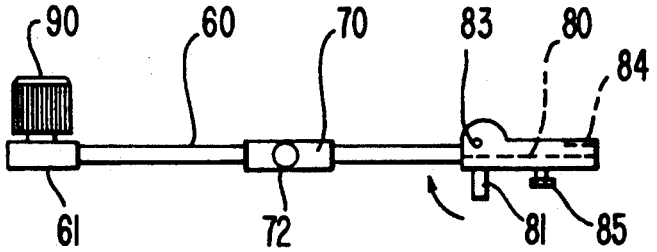
FIG. 9 is a side elevational of the first arm.
Figure 10:
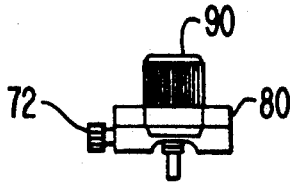
FIG. 10 is a rear elevational view of the first arm.

As shown in FIGS. 8 and 9, the core shaft 81 of the arm mount 80 is partly embedded in a turning member 82 which is held on a shaft 83 extending perpendicularly to the second arm 60 at the end thereof which is joined to the arm mount 80. A groove 84 in which the hook 51 of the first arm 50 engages is defined in an end of the arm mount 80 remote from the turning member 82. A helical spring 85 which abuts against the upper bent portion of the first arm 50 above the x-axis movable member 40 is partly disposed in the lower surface of the arm mount 80. The second arm 60 is normally urged slightly upwardly by the helical spring 85 while being held over the upper surface of the x-axis movable member 40. When the distal end of the second arm 60 is depressed downwardly while drawing an elliptical pattern, a predetermined drawing pressure is applied to the drawing instrument mounted on the attachment 70.

The manner in which the elliptical curve drawing device is used and its operation will be described below.

A drawing instrument is mounted on the drawing instrument attachment 70. Thereafter, the arms 50, 60 are oriented perpendicularly to the front longer side 11 of the base plate 10 as shown in FIG. 3. The screw 72 of the drawing instrument attachment 70 is loosened, making the attachment 70 slidable along the second arm 60. Distance A, half of the minor axis of an ellipse to be drawn, is set as the distance between the central graduation on the longer side 11 of the base plate 10 and the tip end of the drawing instrument mounted on the attachment 70. Then, the arms 50, 60 are turned 90°, and the y-axis movable member 20 is moved to the lefthand ends of the rails 17, 18 until the pin 23 is positioned at the center of the front longer side 11. The adjustment screw 31 is loosened, and the first arm 50 is slid, setting distance C, half of the major axis of the ellipse, as the distance up to the tip end of the drawing instrument. At this time, a value B which determines the eccentricity of the ellipse can be set by reading the graduation 11*a* (see FIG. 3(*a*)) front side 11 which is aligned with the position of the pin 44.

After distance A and distance C have been set by the first and second arms 50, 60, the front side 11 of the base plate 10 is aligned with the x-axis and the center of the front side 11 is aligned with the center O of the ellipse in a position where the ellipse is to be drawn on a sheet of drafting paper. The base plate 10 is then fixed in position by one hand of the user, and the knob 90 is gripped and turned 180° by the other hand of the user. The x-axis movable member 40 now moves along the rails 13, 14, enabling the drawing instrument to draw one half of the ellipse as shown in FIG. 2. The other half of the ellipse can be drawn on the sheet of drafting paper when either the sheet of drafting paper or the drawing device is turned 180° and then fixed in position, and the knob 90 is gripped and turned 180° again.

If the base plate 10 is directed such that the front side 11 thereof is seen perpendicularly to the user, as shown in FIG. 3, then the user can easily see the path along which the drawing instrument moves.

Although a certain preferred embodiment has been shown and described, it should be understood that many changes and modifications may be made therein without departing from the scope of the appended claims.

WHAT IS CLAIMED IS:

1. A device for drawing an elliptical curve having a major x-axis 2(A+B) and a minor y-axis 2A, said axes being perpendicular to one another, said device comprising:

a generally planar base plate having a straight side;

an elongated x-axis guide track structure mounted on said base plate, said x-axis guide track structure extending along said straight edge, said x-axis guide track structure comprising a pair of elongated, longitudinally extending, laterally spaced, x-axis guide rod elements having circular transverse cross-sectional configurations;

an elongated y-axis guide track structure mounted on said base plate, said y-axis guide track structure extending perpendicularly to said straight edge and having a first center line extending therealong, said y-axis guide track structure comprising a pair of elongated, longitudinally extending, laterally spaced y-axis guide rod elements having circular transverse cross-sectional configurations, said y-axis guide rod elements being disposed on opposite sides of said first center line, said guide member track structures being fixed relative to one another;

a y-axis movable member mounted on said y-axis guide track structure, said y-axis movable member having a pair of spaced first openings therein, said y-axis guide rod elements each being received in a respective one of said first openings, said first openings permitting movement of said y-axis movable member along said y-axis guide rod elements with the y-axis guide rod elements disposed therein;

pivot structure carried by said y-axis movable member for movement therewith along said y-axis guide track structure, said pivot structure being pivotally mounted on said y-axis movable member for rotation about a first axis extending through said first center line and perpendicularly to the plane of said base plate;

an x-axis movable member mounted on said x-axis guide track structure, said x-axis movable member having a pair of spaced second openings therein, said x-axis guide rod elements each being received in a respective one of said second openings, said second openings permitting movement of said x-axis movable members along said x-axis guide rod elements with the x-axis guide rod elements disposed therein;

an elongated first arm having a pair of spaced ends and a second center line extending between said ends, said pivot structure including a releasable clamp gripping one end of the first arm, the other end of said first arm being pivotally mounted on said x-axis movable member for movement therewith along said x-axis guide track structure and for rotation relative thereto about a second axis extending perpendicularly of the plane of said base plate, said first and second axes being disposed to extend through said second center line, said clamp being selectively releasable to permit movement of the arm relative to the pivot structure in a direction longitudinally of the arm to thereby change the magnitude of the distance B between said first and second axes;

an elongated extension arm detachably mounted on said outer end of the first arm for movement with said first arm as it pivots about said first and second axes, said extension arm extending outwardly away from said x-axis movable member on the opposite side thereof from said one end of the first arm, said elongated extension arm having a third center line extending therealong, said third center line being disposed in end-to-end alignment with said second center line; and a drawing instrument adjustably mounted on said extension arm at a position spaced from said second axis by the distance A, said instrument being movable along said extension arm to selectively change the magnitude of said distance A, said drawing instrument being mounted for making its mark at a point disposed beneath said third center line.

2. A device according to claim 1, wherein said straight side of the base plate is marked with graduations.

3. A device according to claim 1, wherein said second arm has a resilient member acting on said x-axis movable member for normally urging the second arm upwardly from a horizontal direction.

4. A device according to claim 1, wherein said second arm has, on a distal end thereof, a knob for turning the second arm about said core shaft on said x-axis movable member.

* * * * *

UNITED STATES PATENT AND TRADEMARK OFFICE

CERTIFICATE OF CORRECTION

PATENT NO. : 5,189,800

DATED : March 2, 1993

INVENTOR(S) : SHIRO MORITA and KAZUO YOSHITAKE

It is certified that error appears in the above-identified patent and that said Letters Patent is hereby corrected as shown below:

Column 5, line 23, after "Fig. 3(a))" insert --on the--.

Signed and Sealed this

Fourteenth Day of December, 1993

*Attest:*

Bruce Lehman

BRUCE LEHMAN

*Attesting Officer*

*Commissioner of Patents and Trademarks*